US006220436B1

(12) United States Patent
Chung

(10) Patent No.: US 6,220,436 B1
(45) Date of Patent: Apr. 24, 2001

(54) BOOK ORGANIZER

(76) Inventor: Charles Chung, 4F, No. 42, Lane 244, Jui An St., Taipei City (TW)

( * ) Notice: Subject to any disclaimer, the term of this patent is extended or adjusted under 35 U.S.C. 154(b) by 0 days.

(21) Appl. No.: 09/515,024

(22) Filed: Feb. 29, 2000

(51) Int. Cl.[7] ..... B65D 85/00

(52) U.S. Cl. ..... 206/424; 383/9; 383/39; 383/117; 383/119

(58) Field of Search ..... 206/424, 308.1; 383/9, 38–40, 117, 119

(56) References Cited

U.S. PATENT DOCUMENTS 2,832,389 * 4/1958 Smith ..... 383/9
3,717,188 * 2/1973 Green ..... 383/39
4,852,783 * 8/1989 Bryden et al. ..... 383/39
5,238,305 * 8/1993 Feller ..... 383/117
5,337,907 * 8/1994 McKenzie et al. ..... 383/39
5,547,077 * 8/1996 Wang ..... 383/39
5,692,608 * 12/1997 Simien ..... 383/119
5,779,033 * 7/1998 Roegner ..... 383/39
5,950,826 * 9/1999 Lykowski ..... 383/40

* cited by examiner

*Primary Examiner*—Jim Foster
(74) *Attorney, Agent, or Firm*—Pro-Techtor International Services

(57) ABSTRACT

A book organizer having a cloth base panel, and a plurality of individual cloth bags connected in series to a bottom side of the base panel by stitches for holding books, the cloth base panel having a reinforcing metal sheet embedded therein and a hanging hole reinforced with a metal ring for hanging, the cloth bags each having a small, transparent, plastic outside flap pocket for holding an index sheet.

5 Claims, 5 Drawing Sheets

BOOK ORGANIZER

BACKGROUND OF THE INVENTION

The present invention relates to a book organizer, and more particularly to a cloth book organizer, which can be hung on the wall to hold books in good order, or folded up into a handy manner convenient for carrying with the hand.

A variety of racks and cabinets are commercially available for holding books, clothes, writing materials, sports accessories, personal items, etc. When a big number of things are stored in a rack or cabinet, storage items must be properly classified so that any particular storage item can quickly be identified. FIG. 1 illustrates a regular bookcase for holding books. This structure of bookcase occupies much installation space. Further, this structure of bookcase is not collapsible, and cannot be conveniently carried with the hand.

SUMMARY OF THE INVENTION

It is one object of the present invention to provide a book organizer, which holds books in good order. It is another object of the present invention to provide a book organizer, which occupies little installation space. It is still another object of the present invention to provide a book organizer, which can be folded up for carrying with the hand conveniently. It is still another object of the present invention to provide a book organizer, which is inexpensive to manufacture. To achieve these and other objects of the present invention, there is provided a book organizer comprised of a metal sheet reinforced base panel having a hanging hole for hanging, and a plurality of individual bags connected in series to the base panel by stitches for holding books. A transparent outside flap pocket is provided at each individual bag for holding an index sheet.

DETAILED DESCRIPTION OF THE PREFERRED EMBODIMENT

Figure 1:
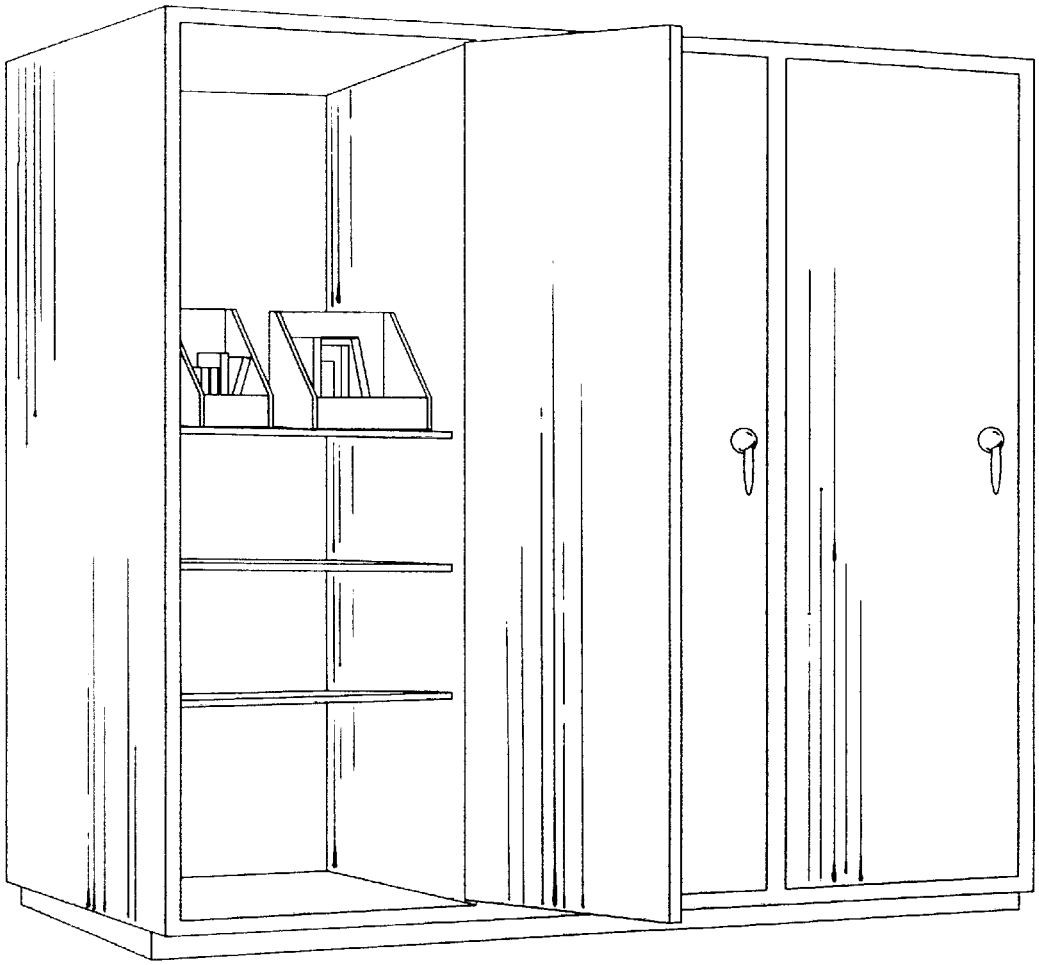
FIG.1 PRIOR ART
FIG. 1 illustrates a regular bookcase.
Figure 2:
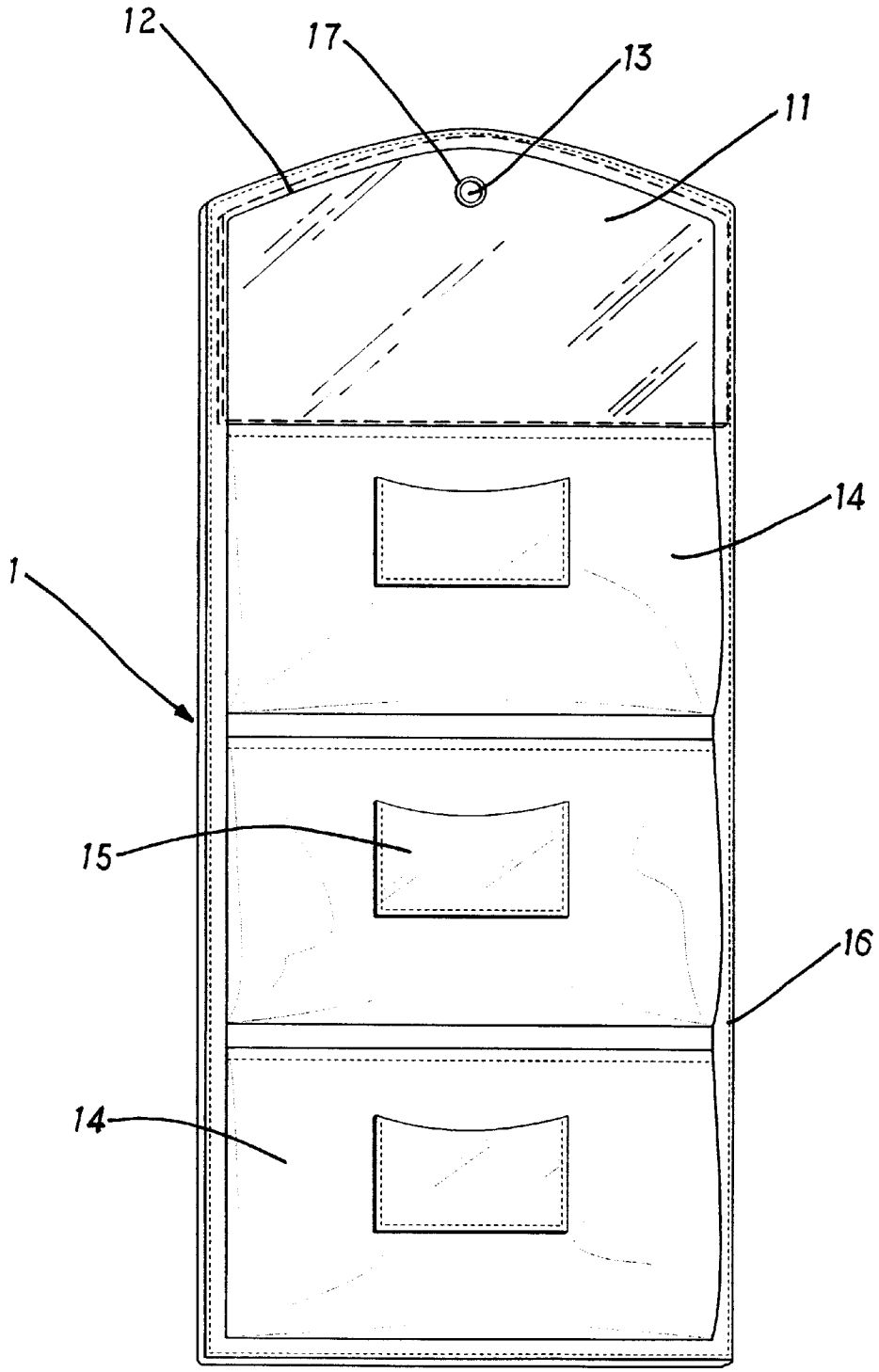
FIG. 2 is a perspective view of the present invention, showing the book organizer extended out.

Referring to FIG. 2, a book organizer 1 is shown comprised of a base panel 11, and a plurality of individual cloth bags 14 connected in series to a bottom side of the base panel 1 by stitches. The base panel 11 is a cloth panel reinforced with a flat metal sheet 12, having a hanging hole 13 for hanging. The hanging hole 13 is reinforced with a metal ring 17. The book organizer 1 has a reinforced edge 16 around the border thereof. Each individual cloth bag 14 has a small, transparent, PVC (polyvinyl chloride) outside flap pocket 15.

Figure 3:
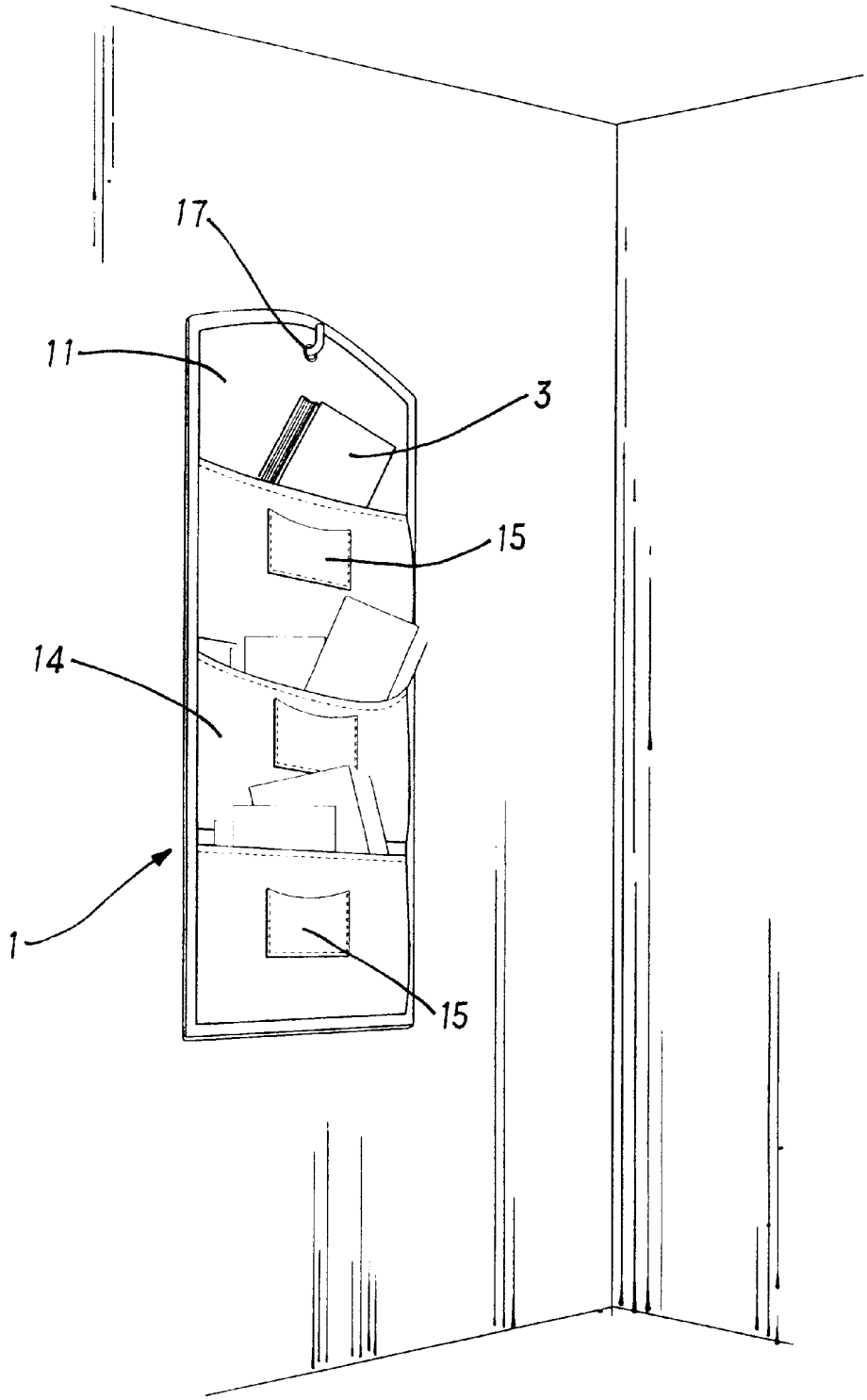
FIG. 3 illustrates an application example of the present invention
Figure 4:
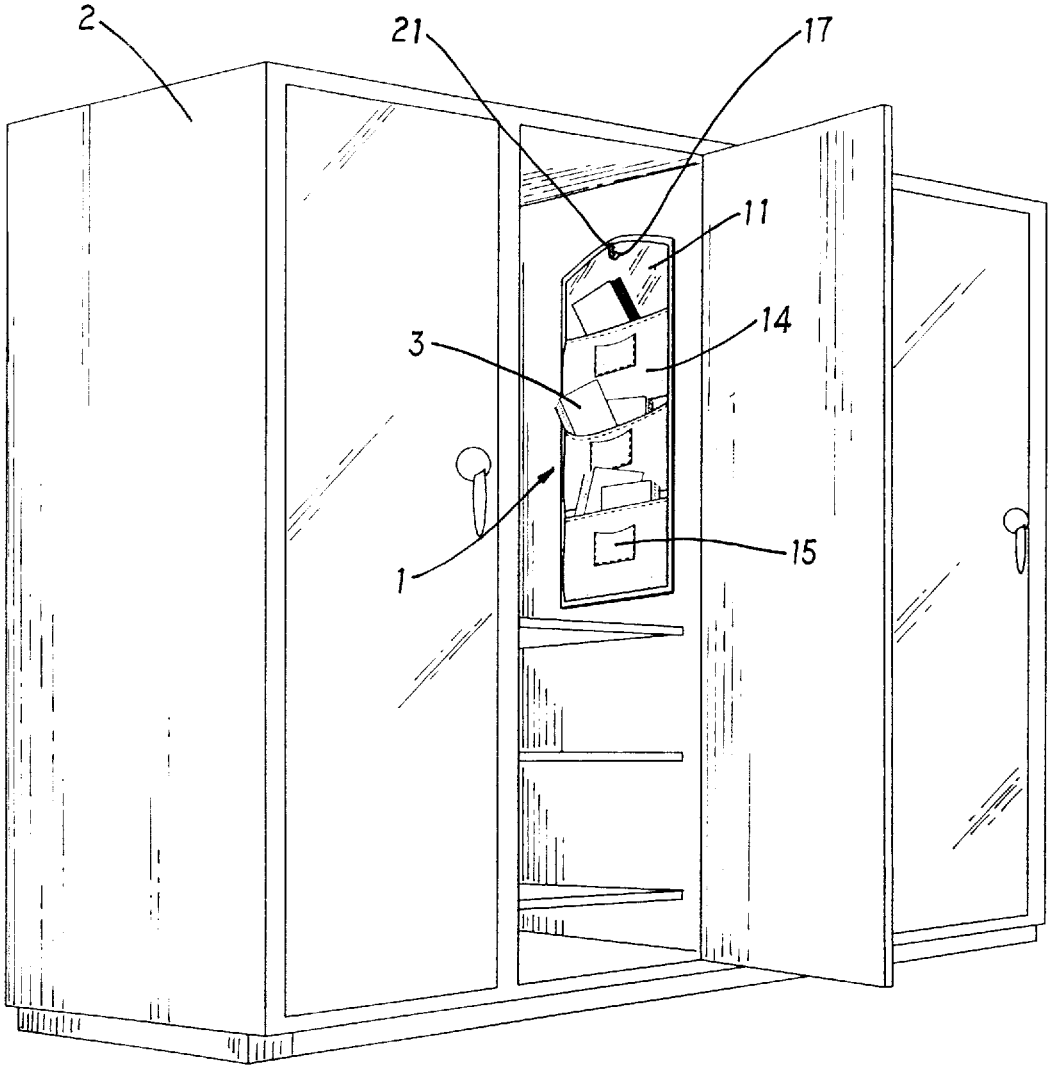
FIG. 4 illustrates another application example of the present invention.

Referring to FIGS. 3 and 4, by means of the hanging hole 13, the book organizer 1 can be extended out and then hung on a nail 21 in the wall of inside a cabinet, enabling books 3 to be conveniently kept in the pockets 14 in a good order. Small items may be kept in the outside flap pocket 15 at each pocket 14. Because the book organizer 1 is flat member when extended out, it requires less installation space. Further, index sheets can be put in the outside flap pocket 15 at each pocket 14 for classification of storage books 3.

Figure 5B:
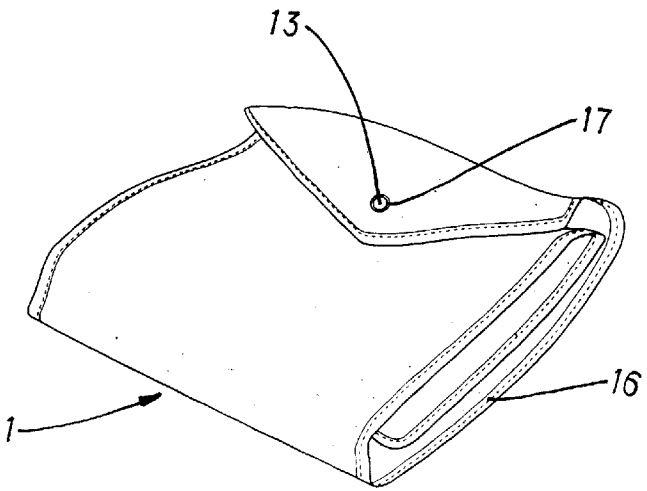
FIG. 5B shows the book organizer folded up according to the present invention (after folding procedure).
Figure 5A:
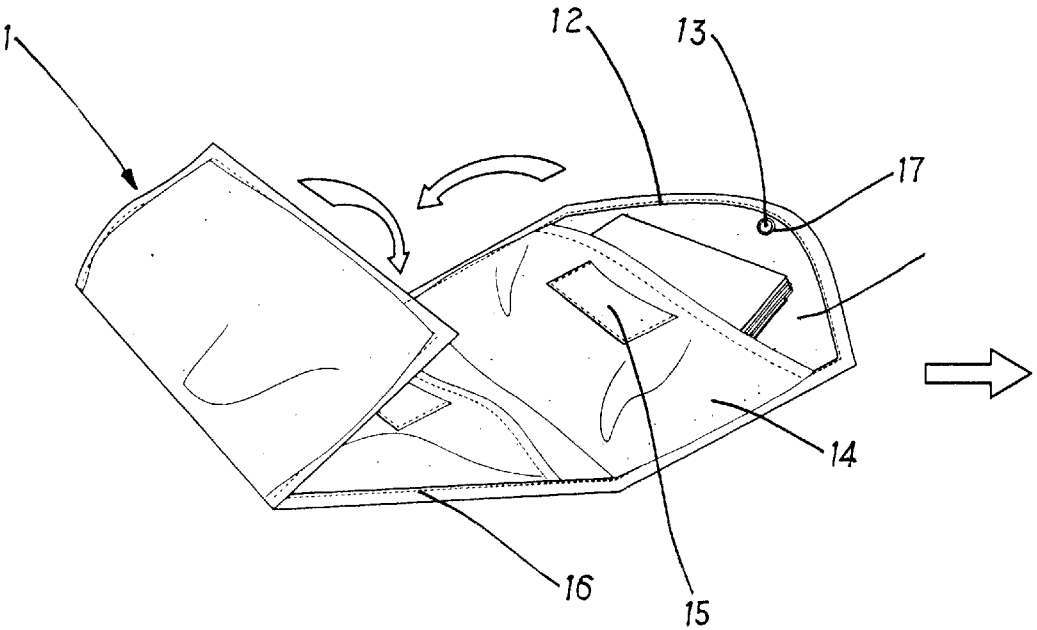
FIG. 5A shows the book organizer folded up according to the present invention (during folding procedure).

Referring to FIG. 5, the book organizer 1 can be folded up and arranged into a handy manner convenient for carrying with the hand.

Referring to FIG. 2 again, because the body of the book organizer 1 is made of cloth, it is durable in use, and can be washed with water.

While only one embodiment of the present invention has been shown and described, it will be understood that various modifications and changes could be made thereunto without departing from the spirit and scope of the invention disclosed.

What the invention claimed is:

1. A book organizer comprising a cloth base panel, and a plurality of individual cloth bags connected in series to a bottom side of said base panel by stitches for holding books, said cloth base panel having a reinforcing metal sheet embedded therein and a hanging hole for hanging.

2. The book organizer of claim 1 wherein said hanging hole is reinforced with a metal ring.

3. The book organizer of claim 1 wherein said cloth bags each have a small, transparent, outside flap pocket for holding an index sheet.

4. The book organizer of claim 3 wherein said small, transparent, outside flap pocket is made of transparent polyvinyl chloride sheet.

5. The book organizer of claim 1 wherein said cloth base panel and said individual cloth bags are peripherally reinforced with a reinforcing edge.

* * * * *